US008763205B2

(12) United States Patent
Schmidhauser et al.

(10) Patent No.: US 8,763,205 B2
(45) Date of Patent: Jul. 1, 2014

(54) RUNNING GEAR ARRANGEMENT HAVING A GUIDE RAIL FOR A SLIDING DOOR

(75) Inventors: Heinz Schmidhauser, Zihlschlacht (CH); Christian Schwendener, Schwarzenbach (CH); Walter Gämperle, Oberuzwil (CH)

(73) Assignee: EKU AG, Sirnach (CH)

( * ) Notice: Subject to any disclaimer, the term of this patent is extended or adjusted under 35 U.S.C. 154(b) by 75 days.

(21) Appl. No.: 13/514,417

(22) PCT Filed: Dec. 17, 2010

(86) PCT No.: PCT/CH2010/000315

§ 371 (c)(1),
(2), (4) Date: Jun. 19, 2012

(87) PCT Pub. No.: WO2011/079400

PCT Pub. Date: Jul. 7, 2011

(65) Prior Publication Data

US 2012/0260460 A1 Oct. 18, 2012

(30) Foreign Application Priority Data

Dec. 18, 2009 (CH) ..... 1950/09

(51) Int. Cl.
*E02D 15/10* (2006.01)
*E05D 15/10* (2006.01)

(52) U.S. Cl.
CPC ..... *E05D 15/10* (2013.01)
USPC ..... 16/92; 49/209

(58) Field of Classification Search
CPC . E05D 15/10; E05D 15/1065; E05D 15/1005; E05D 15/1042
USPC ..... 16/92, 91, 97, 106, 107, 87 B; 49/209, 49/210, 211, 213, 216, 218, 220, 221, 223, 49/225, 409, 425, 410, 411
See application file for complete search history.

(56) References Cited

U.S. PATENT DOCUMENTS

| | | | | | |
|---|---|---|---|---|---|
| 2,774,998 | A | * | 12/1956 | Kiekert | 49/217 |
| 3,169,574 | A | * | 2/1965 | Behlen | 160/368.1 |
| 3,580,183 | A | * | 5/1971 | Nearman | 104/111 |
| 3,843,995 | A | * | 10/1974 | Merrill | 16/97 |
| 4,089,135 | A | * | 5/1978 | Beny et al. | 49/257 |
| 4,708,410 | A | | 11/1987 | Mazaki | |
| 6,094,866 | A | * | 8/2000 | Busnelli | 49/219 |

(Continued)

FOREIGN PATENT DOCUMENTS

| | | |
|---|---|---|
| EP | 0024051 | 8/1980 |
| EP | 0864718 | 9/1998 |
| WO | 2004090274 | 10/2004 |

*Primary Examiner* — Jeffrey O Brien
(74) *Attorney, Agent, or Firm* — Volpe and Koenig, P.C.

(57) ABSTRACT

A sliding device (13), guided on the ceiling (3) or under the floor (7) of a cabinet (1) with a rail element (19), which allows a sliding door (15) to be synchronously pulled away from the closet (1) in a parallel manner and then slid. In order to also guide the lower edge of the sliding door (15), the motion of the sliding door can be transmitted from the upper edge of the sliding door to the lower edge by a transmission shaft. No cavities or guide grooves have to be formed on the cabinet (1) or the floor (7), ceiling (9), side walls (3), or partition wall (5) thereof.

4 Claims, 13 Drawing Sheets

(56) References Cited

U.S. PATENT DOCUMENTS 6,463,625 B2 * 10/2002 Mittag ..... 16/97
7,637,059 B2 * 12/2009 Chang et al. ..... 49/425
7,647,728 B2 * 1/2010 Bortoluzzi ..... 49/209
8,308,221 B2 * 11/2012 Kitayama ..... 296/155
8,375,516 B2 * 2/2013 Baines et al. ..... 16/91
2006/0225357 A1 * 10/2006 Bortoluzzi ..... 49/213

* cited by examiner 83
1
71
73
75
95
5
87
77
79
81
81'
15
79
85
15
7

RUNNING GEAR ARRANGEMENT HAVING A GUIDE RAIL FOR A SLIDING DOOR

BACKGROUND

The subject matter of the present invention is a running gear arrangement with a guide rail for a sliding door.

Sliding doors are used to make a cabinet accessible without having to require room for doors to swing outward. When a cabinet exceeds a certain width, often more than two sliding doors are provided for closing the cabinet. Such known sliding doors move on rails attached to the ceiling and/or in the floor of the cabinet. When one sliding door is opened, it moves in front of or behind the adjacent sliding door. A disadvantage in these sliding doors is the fact that optimal sealing of the cabinet interior is not possible. Furthermore, sliding doors offset in parallel are often not satisfactory in aesthetic terms.

From the prior art, additional sliding doors are known in which each of the at least two sliding doors lie in a common plane in the closed state and can be moved away for opening the cabinet before a sliding motion is possible. In such a known sliding door, the latter must first be pulled away from the cabinet in the area where the two sliding doors bump against each other on their ends or lie next to one another. Here, the sliding door pivots outward, i.e., initially it does not make a parallel motion, but instead a pivoting motion. In the subsequent pushing-to-the-side motion, the remaining part of the sliding door also pivots outward and is pushed in front of the adjacent sliding door parallel to this adjacent sliding door. The sliding doors are here each held by a displacement device that is arranged above or below the cabinet and is guided on two adjacent rails screwed individually to the cabinet. For triggering the pivoting and subsequent parallel adjustment movement, a guide curve in which a guide element attached to the displacement device engages is attached on top of the cabinet or under the cabinet, in order to generate the specified parallel offset. So that the sliding door is also guided exactly parallel at its bottom edge or top edge, if it is supported at the bottom, additional guide means are necessary. These are activated from the supported side by means of suitable synchronization elements. For this purpose, a groove in which a guide element is supported and guided in a pivoting manner must be set in the side opposite the displacement device in the base or the top of the cabinet. A smooth sliding and also an exact parallel guidance of the sliding doors is thus questionable. Due to the non-precise guidance, the sliding doors must be shifted in parallel strongly by the supporting device, in order to prevent mutual contact during the lateral sliding.

SUMMARY

One objective of the present invention is in creating a running gear arrangement with a guide rail for sliding doors that can slide in parallel, wherein this arrangement overcomes the disadvantages of the known arrangements and is possible with a smooth, easily installed mechanism that can be installed with low expense by a carpenter.

This objective is met by a running gear arrangement with a guide rail with the features of the invention. Advantageous constructions of the displacement device are described in the specification and claims which follow.

With the help of a pivoting operating handle that is attached to the support, it is possible to reduce the guide plate needed for the parallel displacement with a curved track to the 90° area of the curved track and to perform the guidance during the displacement of the sliding door by the pivoted operating handle that can be guided longitudinally on an existing guide rail. The installation of the running gear arrangement is therefore reduced to a few manual actions and no complicated or exactly performed milling cuts have to be performed at the carpenter's shop or in the furniture factory. In addition, during the installation work, the rail element can be cut to length to fit the furniture to be manufactured. Additional work, whether at this time in the assembly plant or at the manufacturer of the running gear, is eliminated completely.

The joining of the two parallel guided rails for the support of the displacement device during the longitudinal displacement into a single part made from cut sheet metal or advantageously as an aluminum continuous extrusion part allows the manufacturer of sliding door cabinets (carpenters, furniture factories) to mount the rails on or under a cabinet in a very simple way, wherein the manufacturer only has to set the distance of this single mono-block element to the front edge of the cabinet during installation. The guide curve can also be set in the rail element and only the location of the attachment of the sliding door to the displacement device must be measured and the guide curve must be fixed with a screw. The rail element could also have a narrower construction, i.e., the two rails could lie closer to each other than in known displacement devices, wherein the rail element could also be mounted in cabinets with little depth. The stability of the guide of the sliding door is guaranteed by a longer length of the displacement device in the sliding direction. Alternatively, the displacement device could also be divided into two sections. The guide means for the edge of the sliding door spaced farther away from the displacement device have very simple constructions and are attached to the back side of the sliding door. Only the device for transmitting the movement from top to bottom must be attached to the cabinet itself. In addition, no recesses or the like have to be formed in the cabinet, so that when the sliding doors are closed, an optimal all-around sealing of the sliding doors can be achieved. In addition, the structural height of the displacement device can be reduced compared with known constructions, which results in larger cabinet interior space. With the displacement device according to the invention, sliding doors according to the invention can consequently be attached to any cabinet, e.g., also existing, built-in cabinets, without additional actions, such as forming grooves for guide rails, etc.

BRIEF DESCRIPTION OF THE DRAWINGS

The invention will be described in more detail with reference to an illustrated embodiment. Shown are:

FIG. 13 is an enlarged cross section through the guide elements on the ceiling of the cabinet according to FIG. 12.

DETAILED DESCRIPTION OF THE PREFERRED EMBODIMENTS

Figure 1:
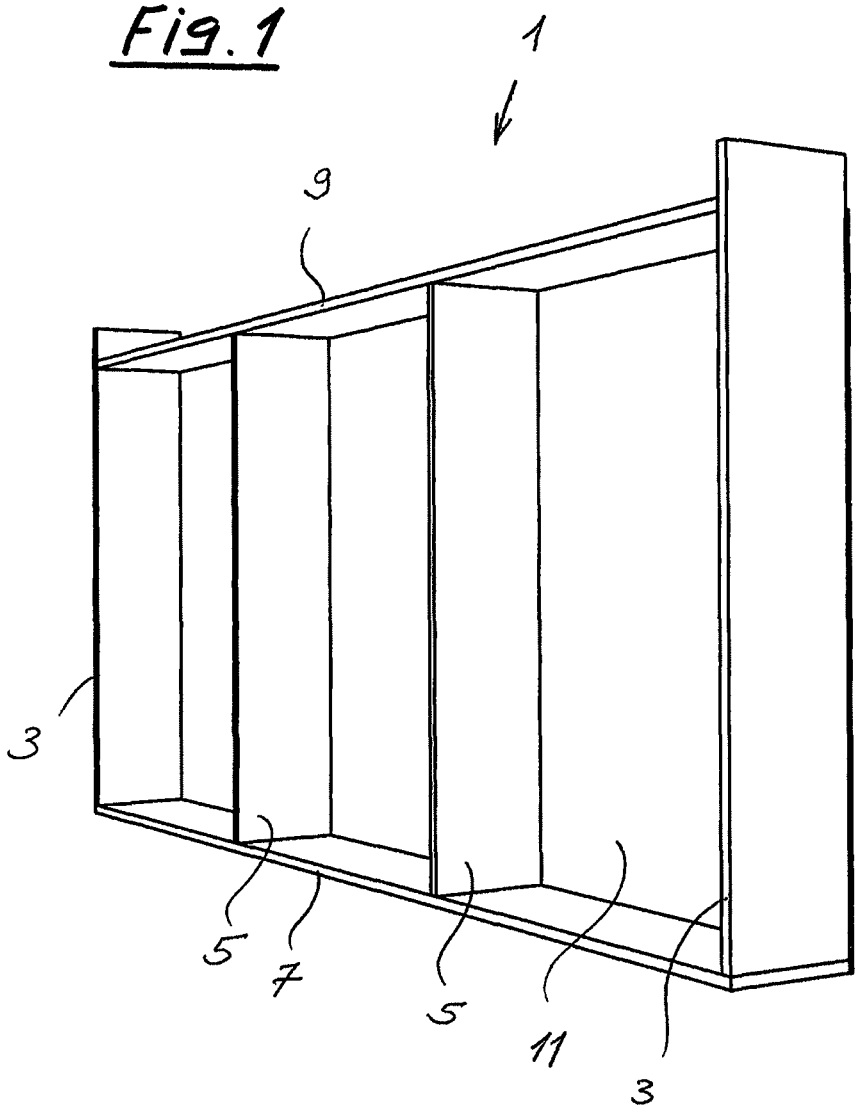
FIG. 1 is a perspective view of a cabinet before installation of the sliding doors and sliding mechanisms.

In FIG. 1, a cabinet 1 is shown with two side walls 3, two partition walls 5, a base 7, and a top 9, as well as a back wall 11. All of the elements of the cabinet 1 are made from rectangular cut pieces. No modifications, such as cuts, grooves for guide rails, openings, etc. are required for installing a running gear arrangement according to the invention for sliding doors 15.

Figure 2:
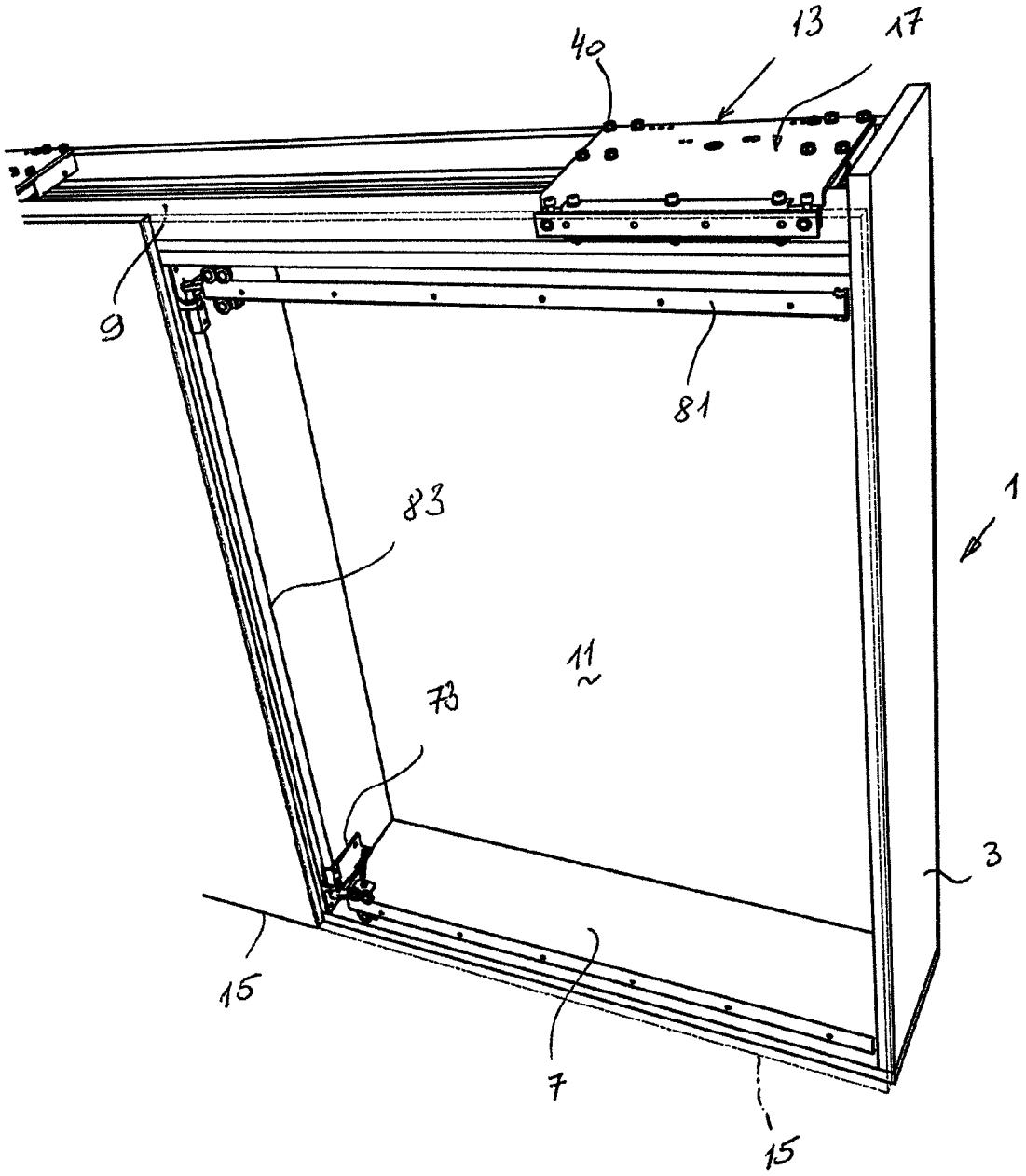
FIG. 2 is a perspective partial top view of the cabinet in FIG. 1 when the sliding doors are closed and of the running gear arrangement arranged on the cabinet for the right sliding door.

In FIG. 2, which shows the upper right half of the cabinet 1, the right side wall 3 is extended upward past the top 9 as a side closure for the running gear arrangement. On the top side of the top 9, a displacement device 13 is visible with a cover 17. The latter is used as dust protection for the functional elements of the displacement device 13 lying underneath. In addition, the cover 17 also acts as an upper rotational bearing for a shaft 45 (FIG. 4), as well as for attachment of the sliding door 15. The displacement device 13 is supported on a rail element 19 that extends across the entire width of the cabinet 1 and is attached to the top 9 or below the base 7. The rail element 19 comprises on each side a lower roller track 21 for support rollers 23 that receive the mass of the sliding door 15. The support rollers 23 are mounted so that they can rotate easily on horizontal shafts or shaft stubs. Upper roller tracks 25 that are arranged parallel to the lower roller tracks 21 and at a distance from these tracks that is only slightly greater than the diameter of the support rollers 23 are formed above the lower roller tracks 21. Between the roller tracks 21, 25 there are, at a constant distance from each other, two additional guide tracks 27 between paired vertical legs 29. These are used for the lateral guidance of guide rollers 31 that are supported so that they can rotate about vertical axes and guide the displacement device 13 laterally and exactly. The distance of the two legs 29 of each guide track 27 is slightly greater, in turn, than the diameter of the guide rollers 31, such that these are guided approximately without play, i.e., when rolling, these are in contact only with one of the two legs 29 as a function of the forces acting on the displacement device 13.

The rail element 19 with the features listed above is advantageously manufactured as a continuous extrusion made from aluminum. Obviously it could also be produced as a bent sheet-metal part made from steel.

Figure 3:
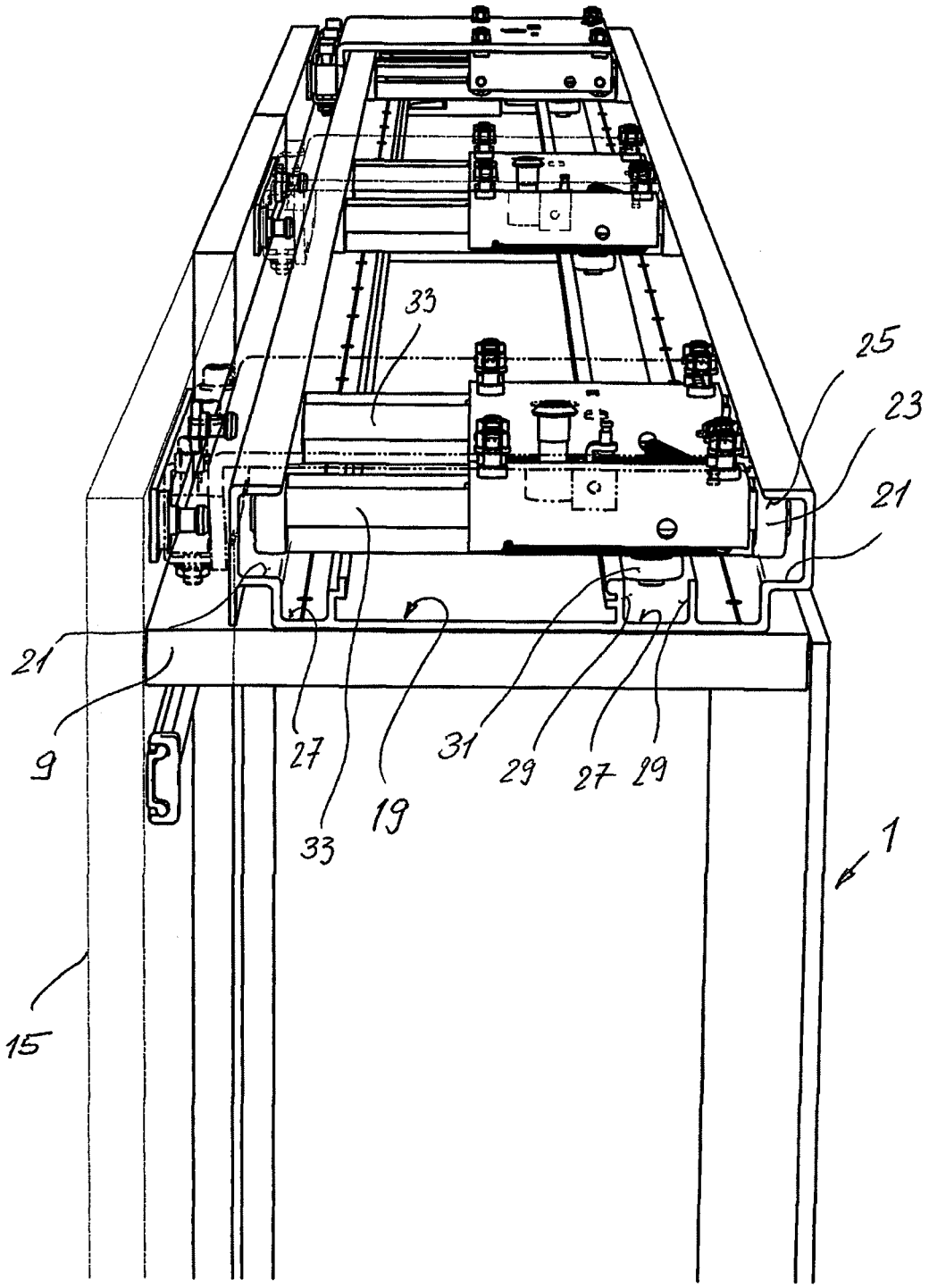
FIG. 3 is an end-side view of the running gear arrangement with partial view of the cabinet.
Figure 4:
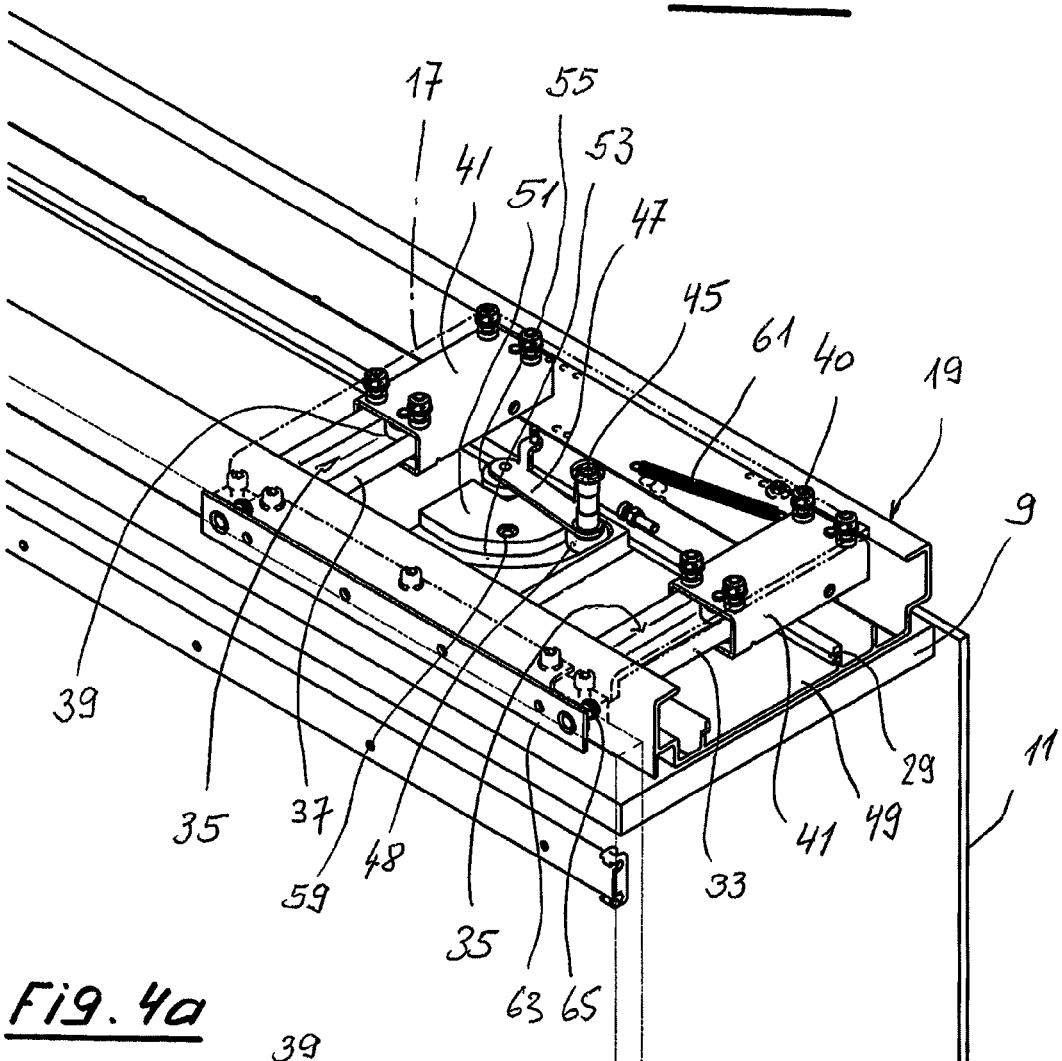
FIG. 4 is a perspective representation of the running gear arrangement with removed cover when the sliding door is closed.
Figure 4A:
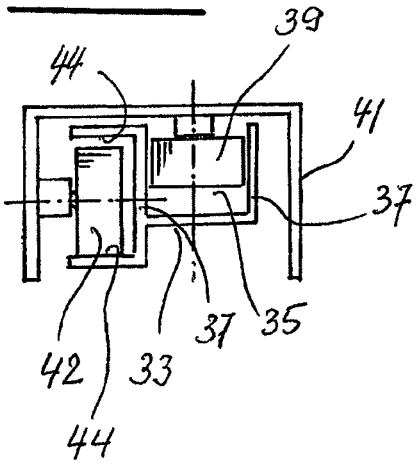
FIG. 4*a* is an enlarged cross section through a cross beam.
Figure 5:
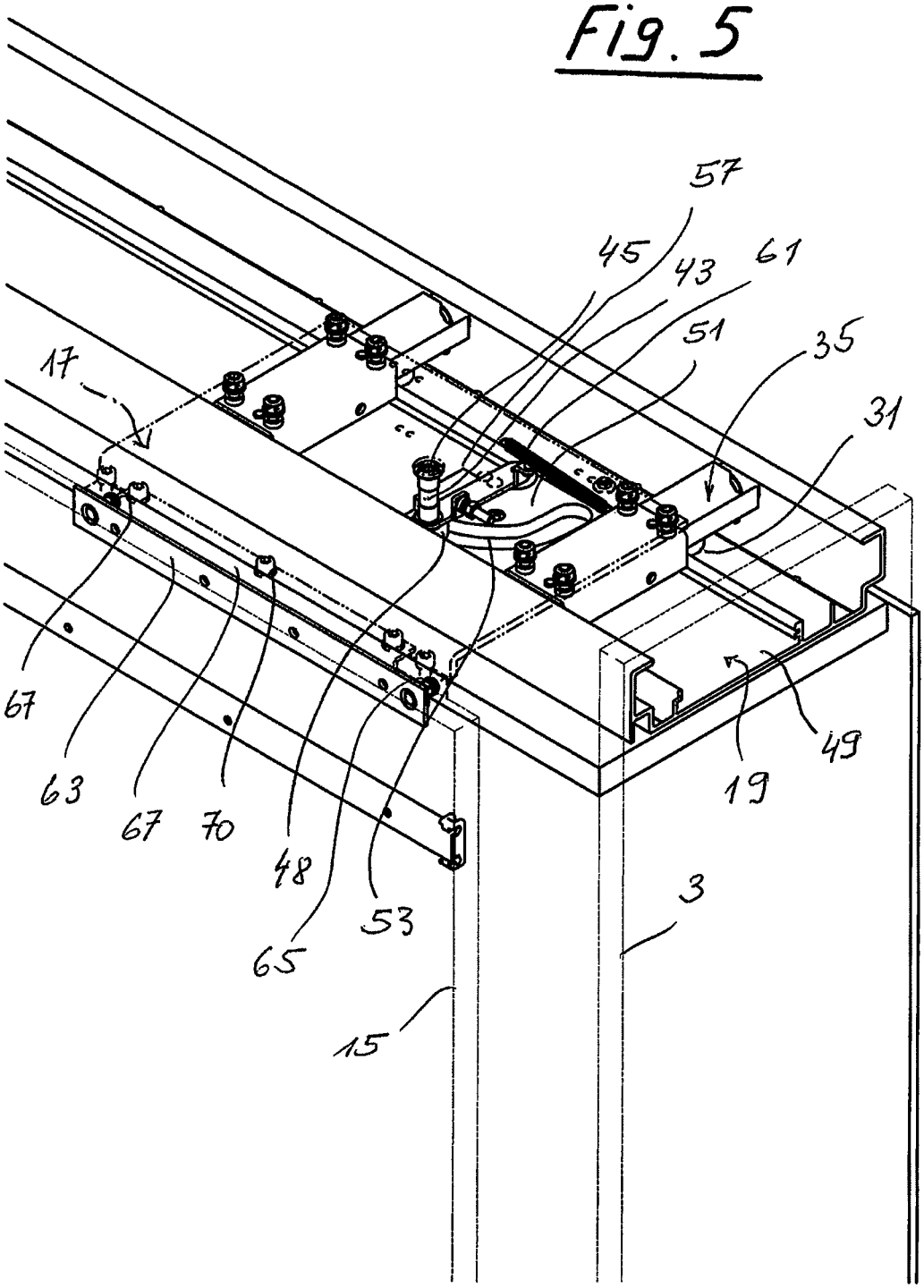
FIG. 5 is a perspective view of the running gear arrangement for partially opened sliding door shifted in parallel.
Figure 6:
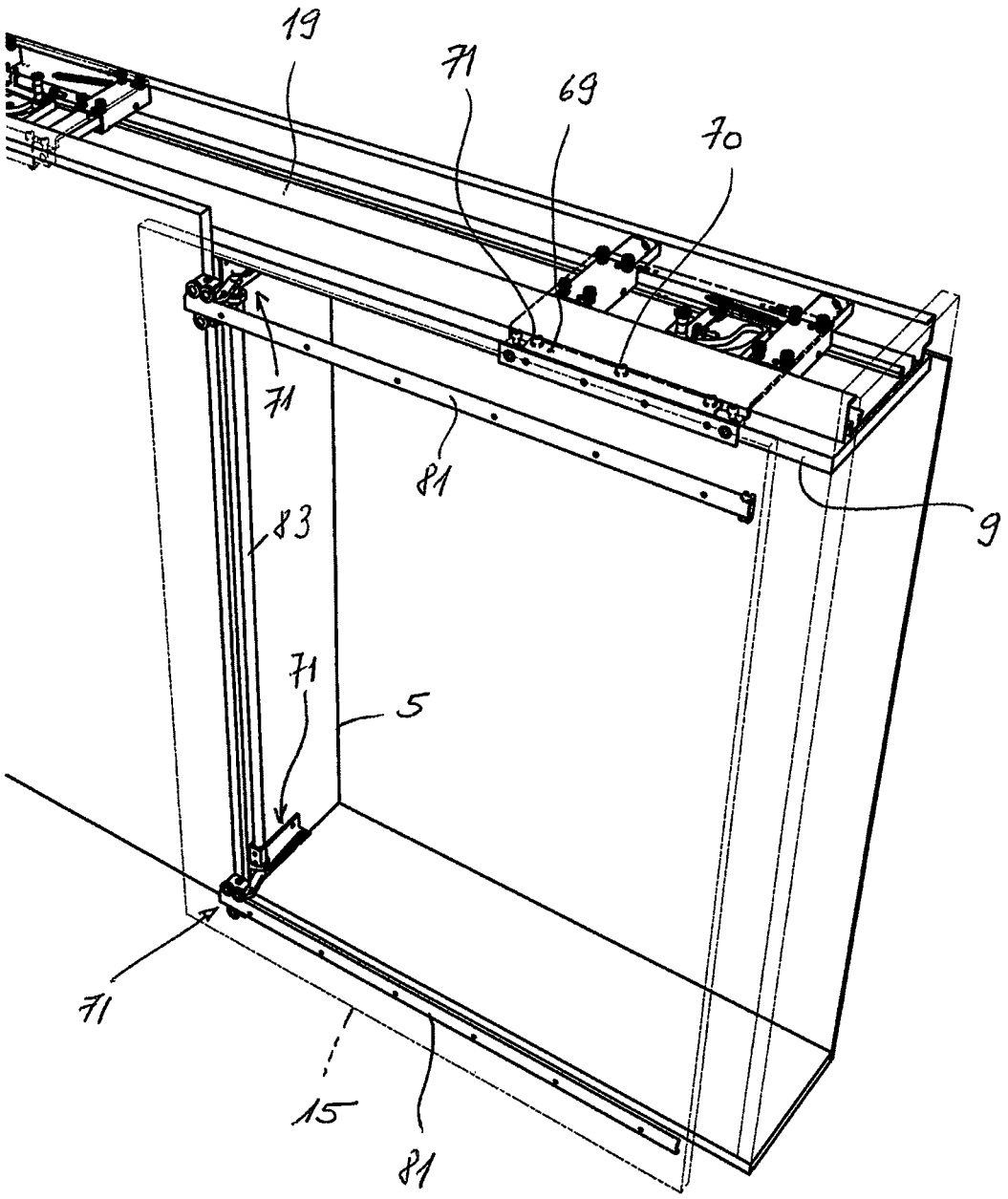
FIG. 6 is a perspective view of the right cabinet part with partially shifted sliding door and representation of the synchronization of the upper and lower guides of the sliding door.

The displacement device 13 further comprises two cross beams 33 arranged at a distance from each other and connected to each other by the cover 17. The four support rollers 23 are supported at the ends of these cross beams (FIGS. 3 to 5). A guide channel 35 that is open at the top and has paired, opposing side walls 37 running parallel to each other is formed in the cross beams 33. Two rollers 39 supported so that they can rotate about a vertical axis and spaced apart from each other engage in this channel from above. The rollers 39 are attached to roller supports 41. The rollers 39 lie with little play between the side walls 37. The two roller supports 41 are connected with screws 40 to the cover 17 used as a bridge. On the roller supports 41, an additional four support rollers 42 are supported so that they can rotate on horizontal axes. The support rollers 42 are guided at the top and bottom in a track 44 formed laterally on the roller support 41 (FIG. 4*a*).

Furthermore, a shaft 45 as a rotational bearing for a sleeve 43 is attached to the cover 17. An operating lever 47 whose free end carries a support roller 55 is attached in a pivoting manner on the sleeve 43. A curve roller 48 is arranged on the lower end of the shaft 45.

A laterally guided guide plate 51 is attached with a locking screw 59 on the base plate 49 of the rail element 19 connecting the two edges to the roller 21 and guide tracks 27 between the roller track 21 and one guide track 27. On its surface, the guide plate 51 comprises a curved track 53 running over approximately 90° and in which the curve roller 48 is guided on both sides. The curve roller 48 is supported on the lower end of the shaft 45 so that it can rotate and projects into the curved track 53. Furthermore, on the guide plate 51 close to the roller track 27 there is a recess 57 that is open in the sliding direction and in which the support roller 55 travels when the displacement device 13 slides over the guide plate 51 when the sliding door 15 is being closed.

The guide plate 51 is held in the vertical and horizontal directions by legs 29 of the roller track 27. In the direction of travel of the sliding doors 15, the guide plate 51 is held by the advantageously self-tapping screw 59 that can be screwed into the base plate 49. The guide plate 51 is attached to the rail element 19 before or after the attachment of the rail element 19 on the cabinet 1.

The cover 17 on which the cross beams 33 are attached is pulled into the retracted position by at least one spring (not shown) according to FIG. 4. A spring 61 that is shown in FIG. 5 and is connected to the end of the operating lever 47 and the cover 17 is used to hold the operating lever 47 in a position oriented at a right angle to the driving direction of the sliding doors 15 or to pull it into this position.

A support rail 63 is attached to the back side of the sliding door 15 with screws in the region of its upper edge. Holding pegs 65 with conical, peripheral grooves are arranged on the support rail 63. The holding pegs 65 engage in closely dimensioned drill holes 67 on a holding bar 69. Fixing screws 70 are screwed into threaded holes at a right angle above the horizontal holes 67 in the holding bar 69. The holding pegs 65 can be fixed without play in the holding bar 69 with these fixing screws. The holding bar 69 is held adjustable on the cover 17 with suitable means, such as screws 70, both in the vertical and also horizontal directions, in order to be able to orient the sliding door 15 relative to the cabinet 1.

Below the function of the displacement device 13 will be described in more detail. The sliding door 15 is pulled at a right angle away from the cabinet 1 from its closed position, i.e., contacting the front edges of the walls of the cabinet 1, at a not shown handle (e.g., shell grip) or directly at a side or top edge of the sliding door 15. Here the curve roller 48 slides along the curved track 53 running initially at a right angle to the rail element 19 and then in an arc shape from the position according to FIG. 4 into the position according to FIG. 5. The support roller 55 here remains in the recess 57. Therefore, at the beginning of the pulling movement, only a parallel displacement of the sliding door 15 away from the front side of the cabinet takes place. The operating lever 47 here rotates about the rotational axis of the support roller 55 remaining in the recess 57. Then the sliding door 15 can move to the left and releases the interior of the cabinet 1. The sliding door 15 can now be pushed so far to the left until it essentially completely overlaps with the adjacent sliding door 15. During the sliding movement, the support roller rolls on the legs 29 of the rear guide track 27.

If the sliding door 15 is closed, i.e., pushed to the right, then at the end of the sliding movement the support roller 55 runs into the recess 57. Then the curve roller 48 slides into the curved track 53 and pulls the sliding door 15 in a translating movement relative to the cabinet 1. Through the straight, last section at the end of the curved track 53, the sliding door 15 cannot open by itself, i.e., move to the left, but instead opens only after being pulled forward manually or electrically by an electric drive.

So that, on one hand, the lower area of the sliding door 15 is also lifted synchronously from the front of the cabinet 1 reliably in a translating motion and, on the other hand, a part of the mass of the sliding door 15 can be supported, a synchronization and support device 71 is attached to the partition wall 5 or only to a holder arranged there. This device comprises an attachment plate 73 on which a transmission shaft 83 is supported so that it can pivot and is held axially by a bracket 75. At the lower end of the transmission shaft 83, a pivot lever 85 is arranged locked in rotation on whose free end a roller support 77 is held so that it can pivot about a vertical axis 87. On the roller support 77, at the top two holding rollers 79 and at the bottom one guide roller 79 are supported so that they can rotate on horizontal axes. The holding rollers 79 lie on the upper edge and on the lower edge of a guide bar 81 attached to the inside of the sliding door 15, wherein the upper holding rollers 79 have a recess, so that the rollers can partially surround the upper edge 81' of the guide bar 81.

An identically constructed synchronization device 71 is also attached to the partition wall 5 in the area of the top 9 of the cabinet 1 and engages there in a guide bar 81 that is connected by screws to the sliding door 15. With a first end, a tension spring 95 is attached to the attachment plates 73. The second end of the tension spring 95 is connected to the roller support 77.

During the translating displacement of the sliding door 15 away from the cabinet 1, the transmission shaft 83 rotates, because it is guided outward by the two roller supports 77 that are connected to the sliding door 15 by means of the guide bars 81. In this way it is guaranteed that the upper edge and the lower edge of the sliding door 15 are likewise simultaneously, i.e., synchronously, displaced in a translating motion. The synchronization device 71 consequently guarantees the parallelism of the translating displacement of the sliding door 15. Furthermore, the synchronization device 71 is also used to support the sliding door 15 on the edge away from the displacement device 13. In each position of the sliding door 15, the lower holding roller 79 supports the sliding door 15 by means of the guide bar 81 and thus prevents torque on the running gear arrangement.

For very wide sliding doors, for better load distribution and for avoiding a large torque on the running gear arrangement, two running gear arrangements are arranged at a distance and next to each other.

Figure 8:
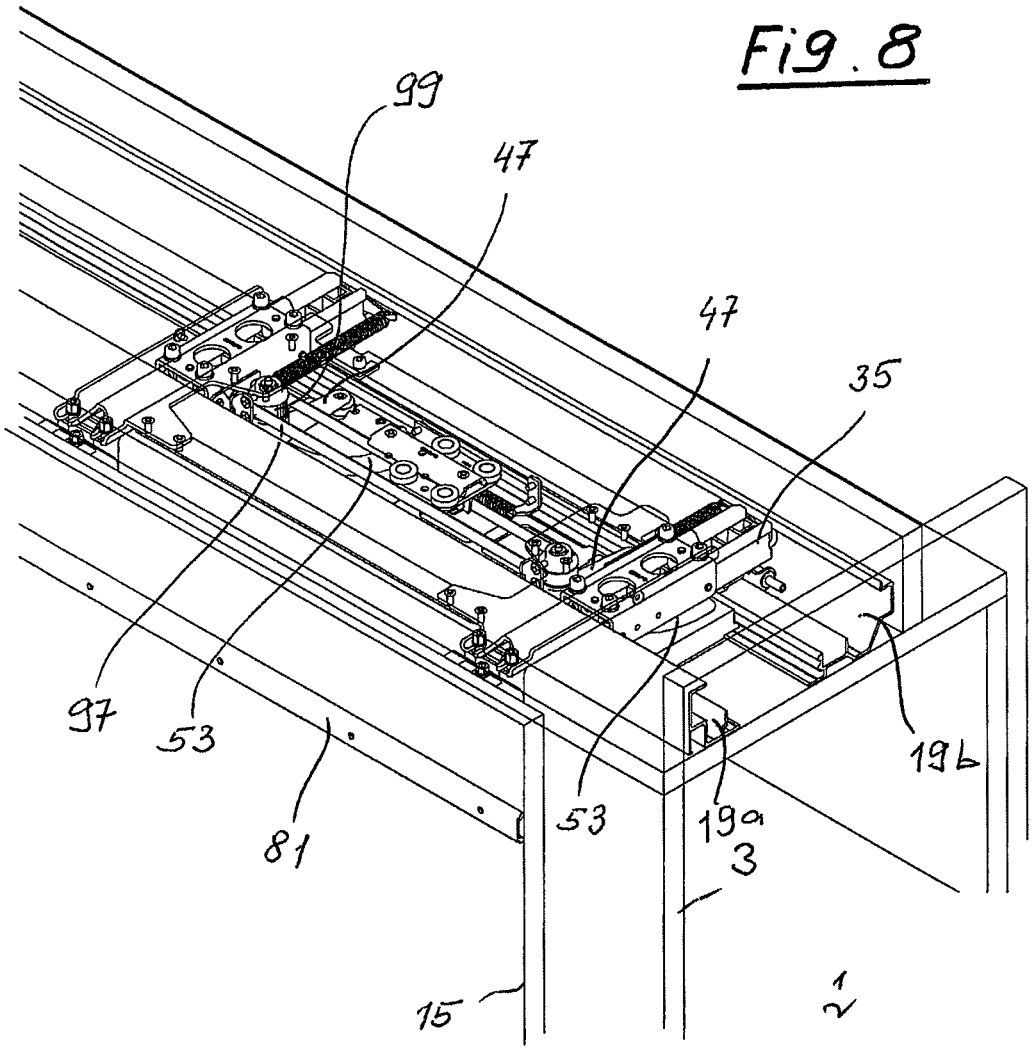
FIG. 8 is a perspective view of the running gear arrangement with another construction of the invention for a partially opened sliding door.
Figure 9:
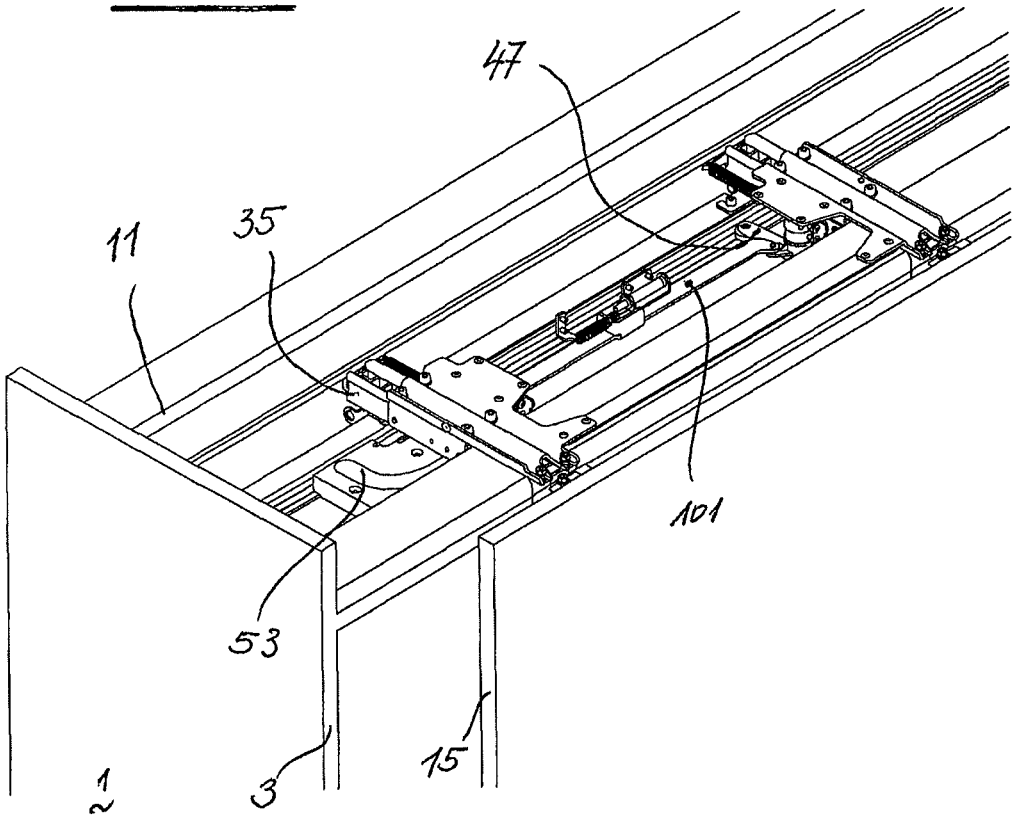
FIG. 9 is a perspective view of the running gear arrangement with another construction of the invention for a partially opened sliding door.
Figure 10:
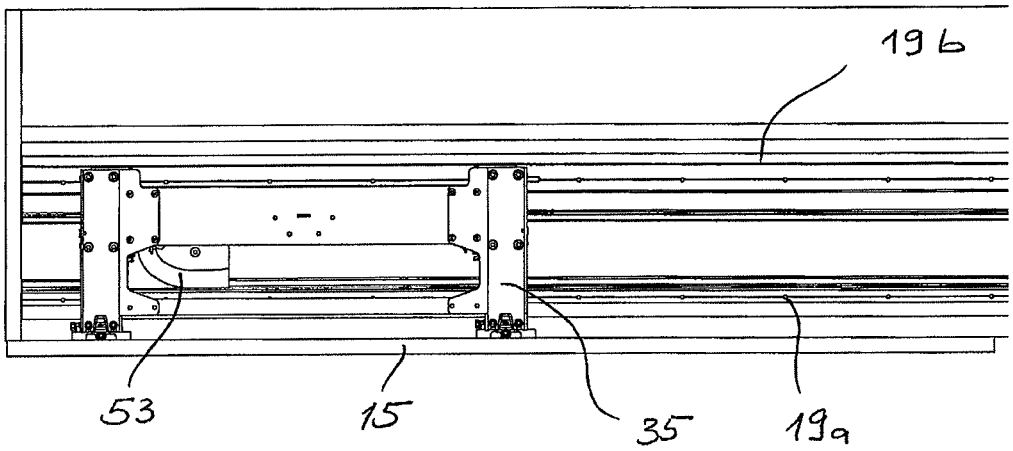
FIG. 10 is a top view of the running gear arrangement according to FIG. 9 when the sliding door is closed.
Figure 11:
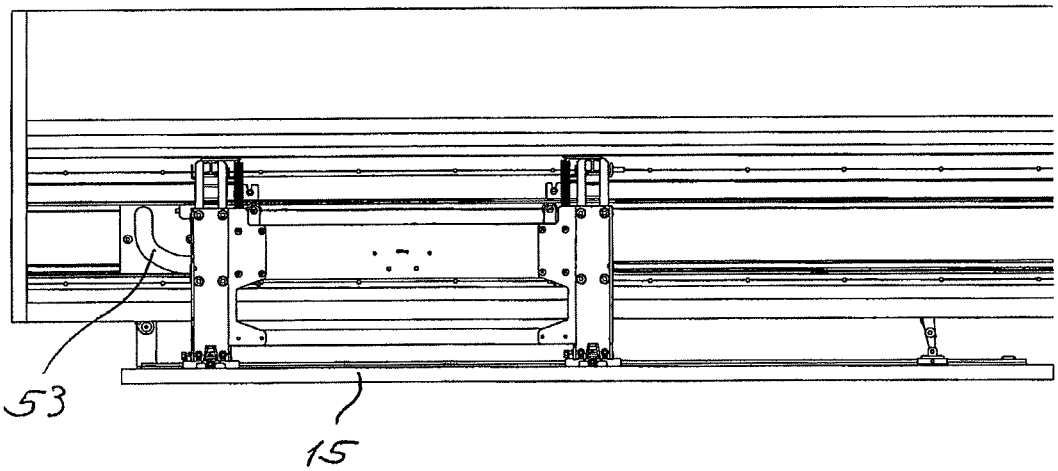
FIG. 11 is a top view of the running gear arrangement according to FIG. 9 when the sliding door is opened.

In the construction of the invention according to FIG. 8, instead of one single operating lever 47, there is also another that synchronizes the pivoting movements of the two levers 47 by means of a synchronization element in the form of a toothed belt 97. The toothed belt 97 meshes with two pinions 99 that are locked in rotation to the levers 47. The pinions 99 sit on the end of the lever 47 that is pivoted by approximately 90° in the clockwise direction by the curved track 53 when the sliding door 15 is lifted. In the construction of the invention according to FIG. 9, instead of a toothed belt 97 there is an articulated rod 101 whose ends are connected in an articulated manner to the ends of the two operating levers 47. As in the example according to FIG. 8, the articulated rod 101 causes an exact synchronization of the pivoting movements of the two operating levers 47.

For the pivoting movement of the operating levers 47 when the sliding door 15 is pulled away from the cabinet 1, a curved track 53 is consequently sufficient that interacts with one of the two operating levers 47. Obviously two curved tracks 53 could also be formed.

Through these synchronous pivoting movements of the operating levers 47 it is guaranteed that the sliding door 15 performs an exact translating movement away from the cabinet 1 and can be displaced laterally into the extended position in a twist-proof manner.

In order to prevent unintentional pivoting of the operating levers 47 during displacement of the sliding door 15, these are held not exactly at a right angle to the rail elements 19*a* and 19*b*, but instead contact them—loaded by springs—somewhat past the dead center point in a stable position (springs not shown).

Figure 7:
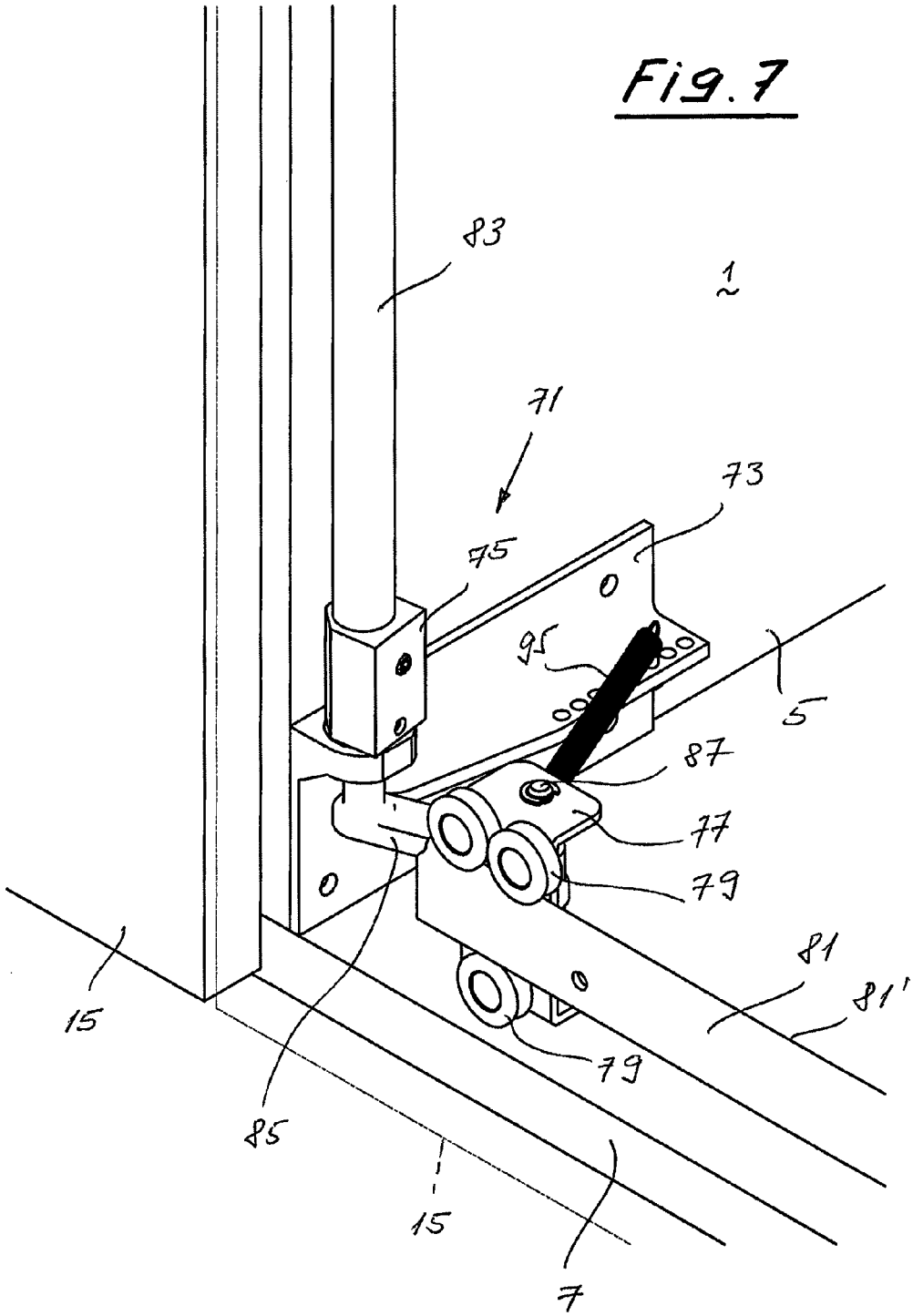
FIG. 7 is a detail view of the lower guide of the sliding door in another construction.
Figure 12:
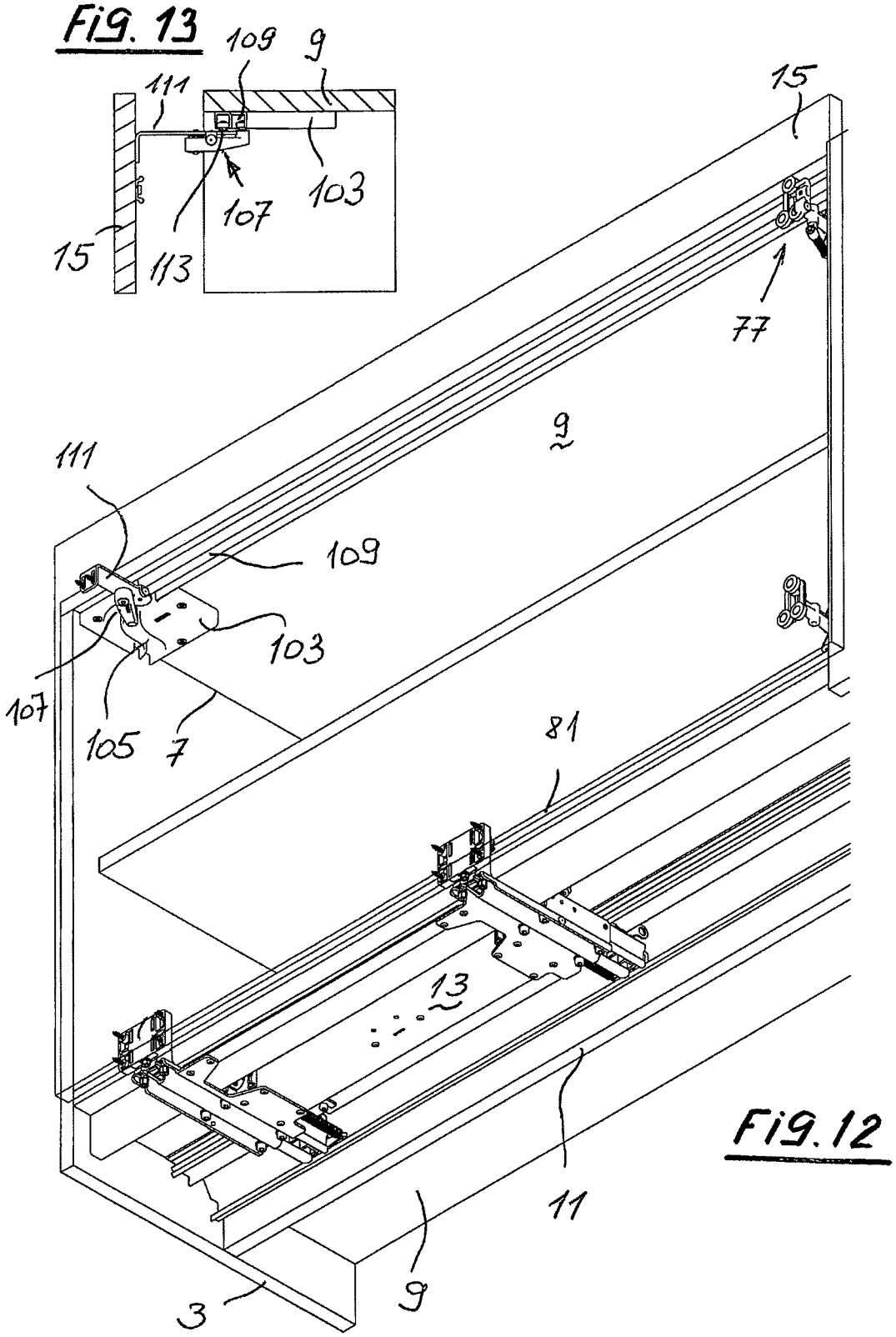
FIG. 12 is a perspective view of the right cabinet part with partially shifted sliding door and representation of the synchronization of the upper and the lower guides of the sliding door according to FIG. 8 or 9, lower running gear arrangement.

In order to also guarantee a similarly secure and stable guidance of the lower edge of the sliding door 15, as in the first construction of the invention according to FIG. 7 on the back side of the sliding door 15, there is a guide bar 81 on which the roller support 77 is guided. The roller support 77 is attached to the transmission shaft 83, in turn, by means of the extension 85. The transmission shaft 83 connects another roller support 77 that is constructed in the same way and attached to a rail 81 in the area of the upper edge of the sliding door. In order to guarantee an additional guidance of the sliding door 15 at each of its edges coming to lie in the area of the side walls 3, a plate 103 with a guide groove 105 can be attached to the top 9 of the cabinet 1. A guide lever 107 attached in an articulated manner to the sliding door 15 engages in the guide groove 105. The guide groove 105 in the plate 103 is connected to a guide rail 109 running parallel to the front edge of the cabinet 1. The guide lever 107 is hinged in an articulated manner to a support bracket 111 and supports, on its free end, a holding roller 113 that is guided in the guide rail 109 during the displacement of the sliding door and slides, at the end of the sliding movement, when the sliding door 15 moves from the extended into the retracted position, out from the guide rail 109 into the guide groove 105 and is held there by a spring on the guide lever in the retracted position or is forced by the spring into the retracted position. Therefore the upper edge lies completely on the cabinet 1 also for use of the displacement device 13 on the bottom side of a cabinet, in particular, a sideboard. During the displacement of the sliding door, the guide lever 7 is used so that the sliding door 15 is always guided at a constant distance to the front edge of the cabinet, even if a person grabs and moves the door in the area of the sliding door edge (FIGS. 12 and 13).

Figure 14:
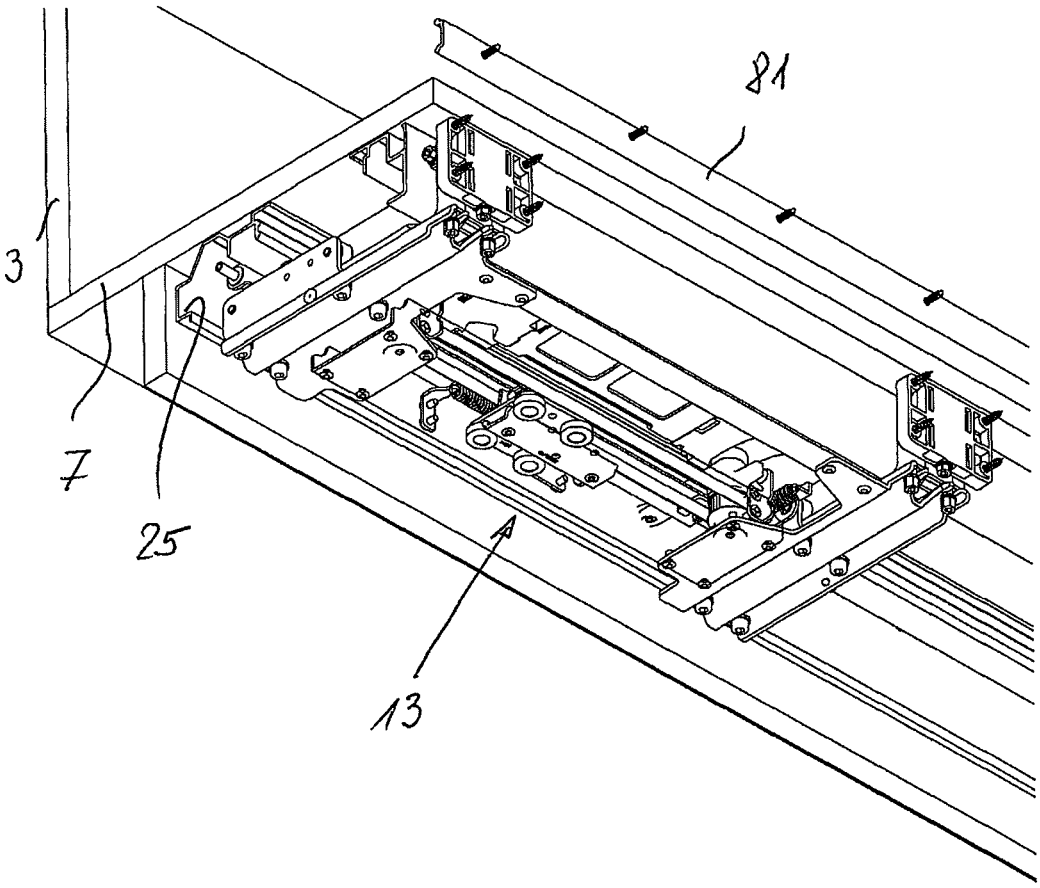
FIG. 14 is a perspective view of a cabinet from below with a running gear arrangement according to FIG. 8.
Figure 15:
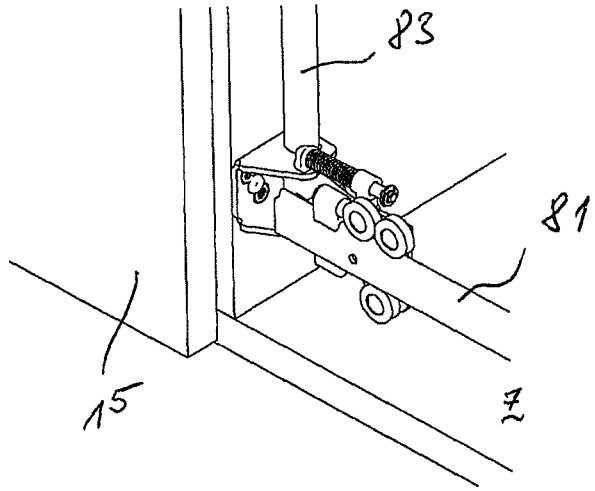
FIG. 15 is an enlarged perspective view of the lower synchronization element when the sliding door is closed.
Figure 16:
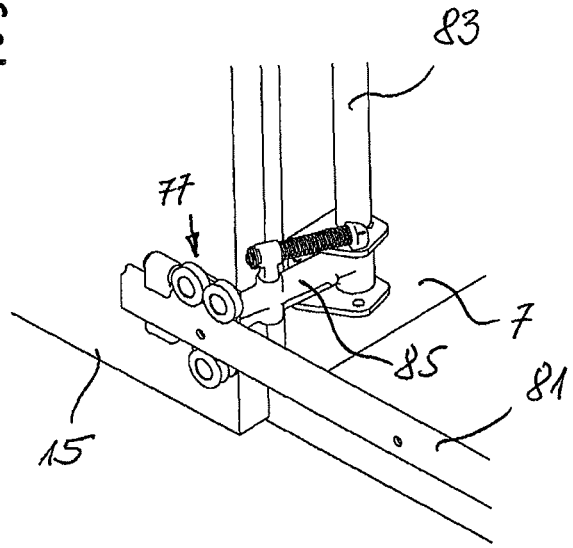
FIG. 16 is an enlarged perspective representation of the lower synchronization element when the sliding door is opened.

The displacement devices 13 shown in FIGS. 1-11 are each mounted on the top 9 of the cabinet, i.e., the sliding door 15 hangs on the displacement device 13. To be able to also attach a displacement device 13 to a low cabinet, e.g., a sideboard, so that it cannot be seen, the displacement device can be attached underneath the base 7 from below. The support rollers 23 then lie on the upper roller track 25 and support the sliding door 15 (FIG. 14).

The invention claimed is:

1. Running gear arrangement with two parallel guide rails (21) for supporting a hanging sliding door (15), comprising a parallel displacement device for a lateral displacement movement and for a parallel lifting the sliding door (15) from a door opening of a cabinet (1), the displacement device (13) is moveable on the guide rails (21) in a displacement direction and a support (33) on the displacement device (13) is movable at a right angle to the displacement direction, a guide element is attached to the support (33) and is engageable in a curved track (53) arranged between the guide rails (21) and guarantees parallel movement during the lateral displacement of the sliding door (15), a synchronization device (71) attachable to a partition wall (5), a base (7), and a top (9) of the cabinet (1) or to a holding element inserted between the base (7) and top (9) and supports a vertical transmission shaft (83) and radial projecting extensions (85) on its ends, wherein roller supports (77) with holding rollers (79) are attached to the radial projecting extensions and the holding rollers (79) contact guide bars (81) and the guide bars (81) are constructed to be attached to an inside of the sliding door (15) and are movable through the holding rollers in the displacement direction with the sliding door.

2. Running gear arrangement according to claim 1, wherein the extensions (85) are vertically adjustable and are retractable with a spring (95).

3. Running gear arrangement according to claim 2, further comprising a plate (103) with a guide groove (105) that is attachable to the base (7) or to the top (9) of the cabinet (1) and a spring-loaded guide lever (107) that is attached in an articulated manner to the sliding door (15) and has a holding roller (113) that engages in the guide groove (105) at an end of a sliding movement of the sliding door (15).

4. Running gear arrangement according to claim 3, wherein the holding roller (113) rolls in a guide rail (109) set in the base (7) or the top (9) when the sliding door (15) is shifted laterally.

* * * * *